US005879410A

United States Patent [19]

Yanai et al.

[11] Patent Number: 5,879,410

[45] Date of Patent: Mar. 9, 1999

[54] PROCESS FOR RESIN FINISHING TEXTILE CONTAINING CELLULOSIC FIBER

[75] Inventors: Yuichi Yanai; Masayoshi Oba; Yasushi Takagi; Tadashi Isogai, all of Okazaki, Japan

[73] Assignee: Nisshinbo Industries, Inc., Japan

[21] Appl. No.: 990,191

[22] Filed: Dec. 12, 1997

[30] Foreign Application Priority Data

Dec. 17, 1996 [JP] Japan ..... 8-353330

[51] Int. Cl.[6] ..... D06M 13/322

[52] U.S. Cl. ..... 8/181; 8/182; 8/183; 8/184; 8/185; 8/186; 8/189; 8/196; 8/115.7; 8/120

[58] Field of Search ..... 8/181, 182, 183, 8/184, 185, 186, 189, 196, 115.7, 120

[56] References Cited

U.S. PATENT DOCUMENTS 3,554,686 1/1971 Tolgyesi et al. ..... 8/185

3,776,692 12/1973 Franklin et al. ..... 8/185

3,827,994 8/1974 Cicione et al. ..... 8/185

*Primary Examiner*—Alan Diamond

*Attorney, Agent, or Firm*—Wenderoth, Line & Ponack, L.L.P.

[57] ABSTRACT

A process for resin finishing textile containing cellulosic fiber comprises the steps of using a resin finishing agent chiefly containing a cellulose-reactive N-methylol compound having two or more functional groups and a reaction catalyst, mainly reacting only one functional group of the cellulose-reactive N-methylol compound with cellulose, water washing, again imparting reaction catalyst, drying, garment making, and heat treating. The process eliminates the conventional postcuring method drawbacks of loss of color fastness and discoloration owing to dye decomposition and formaldehyde increase by unreacted resin and residual reaction catalyst during long storage before heat treatment, and simultaneously achieves high crease-resistant property, shrink resistance, good feeling, excellent pleating property, and anti-puckering property.

3 Claims, No Drawings

PROCESS FOR RESIN FINISHING TEXTILE CONTAINING CELLULOSIC FIBER

BACKGROUND OF THE INVENTION

1. Field of the Invention

This invention relates to a process for resin finishing textile (i.e., a woven or knit cloth) containing cellulosic fiber which lowers the loss of color fastness, discoloration, rise in free formaldehyde concentration and the like occurring during long storage before heat treatment in postcuring owing to unreacted resin decomposition and/or dye decomposition caused by the action of a reaction catalyst and which ensures high crease-resistant property and shrink resistance, minimal processing discoloration and cloth strength loss, excellent pleating property, minimal puckering and good feeling.

2. Description of the Background Art

Many resin finishing agents and finishing processes have been considered for imparting crease-resistant property and shrink resistance to textiles containing cellulosic fiber.

These processes typically use glyoxalic resin or other so-called cellulose-reactive resin finishing agents. Generally, however, an attempt to enhance crease-resistant property and shrink resistance by imparting a larger amount of such a resin causes various problems owing to the formaldehyde and the like contained in the resin. Specifically, it markedly increases finishing discoloration and loss of color fastness and also hardens the textile feeling and lowers the strength of the finished cloth. On the other hand, reducing the amount of resin imparted improves such properties as finishing discoloration and color fastness but results in insufficient crease-resistant property and shrink resistance. The practice has therefore been to conduct the finishing within the range that gives the optimum mix among the incompatible properties of processing discoloration and color fastness on the one hand and crease-resistant property, shrink resistance and cloth strength on the other.

Resin finishing in postcuring involves making garments from cloth imparted with the resin finishing agent and then heat treating the garment to react and set the resin. At the time of cutting and sewing, the imparted finishing agent has not yet been crosslinked so the textile can be easily pleated and exhibits good anti-puckering property. When the cloth is stored for a long period between the imparting of the resin and the heat treatment for crosslinking the resin, however, decomposition of unreacted resin and the action of the reaction catalyst may reduce the color fastness and increase discoloration and the amount of free formaldehyde.

Different types of reaction catalyst differ considerably in their effect on color fastness. For instance, the effect of an acidic catalyst on the color fastness of a reactive dye is particularly great. Many reactive dyes are used for dyeing knits in view of their superb leveling and coloring performance. When an acidic catalyst is used in the resin finishing of cloth dyed with a reactive dye, however, some of the dye is likely to decompose owing to the action of the acidic catalyst if the cloth is stored for a long period following the imparting of the resin finishing agent. On the other hand, while use of a neutral metallic salt catalyst does not cause the dye decomposition encountered with an acidic catalyst, the neutral metallic salt catalyst must be used in a large amount when a large amount of resin is used to secure high crease-resistant performance. The reactive dye is therefore apt to suffer finishing discoloration and/or nitrogen oxide discoloration.

An object of this invention is to provide a process for resin finishing textiles which eliminates the aforesaid drawbacks of the postcuring method, namely, the problems of loss of color fastness, discoloration owing to dye decomposition and formaldehyde increase by unreacted resin and residual reaction catalyst during long storage before heat treatment, and which simultaneously achieves high crease-resistant property, shrink resistance, good feeling, excellent pleating property, and anti-puckering property.

SUMMARY OF THE INVENTION

This invention was accomplished based on the discovery that the aforesaid object can be achieved in postcuring by, when resin finishing a textile containing cellulosic fiber using a resin finishing agent chiefly containing a cellulose-reactive N-methylol compound, also sometimes called "resin," having two or more functional groups and a reaction catalyst, mainly reacting only one functional group of the cellulose-reactive N-methylol compound with cellulose (hereinafter called "one-handed reaction"), water washing, again imparting reaction catalyst, drying, garment making, and heat treating.

DETAILED DESCRIPTION OF THE PREFERRED EMBODIMENTS

The invention will now be explained in detail.

The cellulosic fiber contained in the textile treated by the process of this invention may be of any type insofar as it can react with the cellulose-reactive N-methylol compound. Examples include such natural fibers as cotton, linen and ramie and such regenerated cellulose fibers as rayon, cuprammonium rayon, polynosic rayon and Tencel It may also be a composite fiber made of natural or regenerated cellulose fiber blended with an animal fiber such as wool or silk or with a synthetic fiber such as polyester or nylon.

These textiles (cloths made by weaving or knitting) containing cellulosic fiber may be pretreated as required by, for example, singeing, desizing, refining, mercerizing, liquid ammonia treatment or the like.

Cellulose-reactive N-methylol compounds and reaction catalysts can be used as resin finishing agents in the invention.

Usable cellulose-reactive N-methylol compounds include dimethylolurea, dimethylolethyleneurea, dimethyloldihydroxyethyleneurea, methylated trimethylolmelamine, their derivatives and the like. Among these, dimethyloldihydroxyethyleneurea (dimethylolglyoxalmonoureine) is typical.

The reaction catalyst used in the invention can be one ordinarily employed in resin finishing. Examples include free acids, ammonium salts and metallic salts.

Specific examples include citric acid, acetic acid, formic acid, ammonium chloride [$NH_4Cl$], secondary ammonium phosphate [$(NH_4)_2HPO_4$], zinc fluoroborate [$Zn(BF_4)_2$], magnesium chloride [$MgCl_2$], zinc nitrate [$Zn(NO_3)_2$] and zinc chloride [$ZnCl_2$].

In the process of the invention, an auxiliary can be added as needed for smooth reaction of the cellulose and resin in the invention. An auxiliary is used which promotes the one-handed reaction between the cellulose-reactive N-methylol compound and the cellulose required by the invention, helps to make the crosslinking reaction uniform, and exhibits other such effects of a reaction solvent while also swelling the cellulose.

Auxiliaries exhibiting these effects include glycerin, ethyleneglycol, polyethyleneglycol, polypropylenegylcol, and other polyhydric alcohols.

These auxiliaries are incorporated in the resin finishing agent so as to swell the cellulosic fiber, promote migration of the cellulose-reactive N-methylol compound in the fiber, and make the crosslinking points uniform. By reacting with the cellulose to produce crosslinking and reacting with the cellulose-reactive N-methylol compound, these auxiliaries are themselves involved in the generation of crosslinks as chain extenders.

In this invention, aside from the aforesaid auxiliary, there can also be added as required a softener for adjusting feeling, a formaldehyde catcher for reducing free formaldehyde and the like.

The invention does not particularly limit the method of imparting the resin finishing agent to the textile containing cellulosic fiber. Any of various well-known methods such as the ordinary pad dry method can be used.

The resin finishing agent used in the invention is preferably used as dissolved or dispersed in water to prepare a treatment solution having a solids content of 30–80 g/liter. When the solids content is under 30 g/liter, the resin finishing effect is insufficient, and when it is over 80 g/liter, the decline in cloth strength is pronounced.

As in the conventional process, the amount of reaction catalyst used when imparting the resin finishing agent is preferably about 5–25 wt % (as solids) based on the amount of the cellulose-reactive N-methylol compound. When it is less than 5%, the reaction time is intolerably long, and when it is greater than 25%, the reaction activity becomes so high as to make reaction control difficult.

When an auxiliary such as polyethyleneglycol is added to the treatment solution, it is preferably added at not more than 100 g/liter. Addition of more than 100 g/liter causes yellowing during processing an other drawbacks. The lower limit of addition is 10 g/liter.

The textile containing cellulosic fiber is soaked in the treatment solution containing the resin finishing agent, squeezed at a pickup of 60–120%, and dried by heating to cause one-handed reaction.

One-handed reaction as termed with respect to this invention refers to reaction of mainly only one functional group of a cellulose-reactive N-methylol compound having two or more functional groups with the cellulose. This is based on viewing the functional groups of the cellulose-reactive N-methylol compound metaphorically as hands. Cellulose reacts with only one of the hands. The mechanism of the one-handed reaction is approximately as follows.

In the course of the reaction of the cellulose-reactive N-methylol compound, one functional group first forms a covalent bond with cellulose. Since the mobility of the remaining unreacted functional groups is depressed in this state, their reaction (crosslinking reaction) requires more activation energy than required by the one-handed reaction. In the reaction between the resin and the cellulose, the one-handed reaction therefore takes precedence over the crosslinking reaction.

In a temperature range not providing sufficient activation energy for crosslinking reaction, the precedence of the one-handed reaction is very pronounced. On the other hand, when the resin reaction proceeds in a temperature range providing sufficient activation energy for crosslinking reaction, both the one-handed reaction and the crosslinking reaction occur simultaneously.

The cellulose-reactive N-methylol compound having undergone one-handed reaction with cellulose in this manner does not wash out of the cloth by soaping and only the unreacted cellulose-reactive N-methylol compound and the reaction catalyst, which cause loss of color fastness, discoloration and formaldehyde increase, are selectively removed.

The temperature and time conditions for producing the one-handed reaction cannot be defined generally because the activation energy for the one-handed reaction and the activation energy for the crosslinking reaction differ with the type and amount of the imparted resin finishing agent, the type and amount of added catalyst, and the combination of resin finishing agent and catalyst. However, a person skilled in the art will be able to determine optimum one-handed reaction conditions for individual combinations of resin and catalyst by conducting the preliminary test described below. A temperature in the range of 80°–105° C. and a reaction period in the range of 20–5 minutes are generally preferable.

Preliminary test procedure

1. Set provisional one-handed reaction conditions for the resin finishing agent to be tested.
2. Prepare pleat test cloth by imparting resin finishing agent to cloth, conducting one-handed reaction under the set conditions, water washing, imparting catalyst again, and drying (105° C.×1.5 min).
3. Check whether one-handed reaction occurred by conducting a pleat durability test as follows:

Pleat the test cloth with a flat press under conditions of 0.5 kg/cm$^2$ surface pressure at 150° C.×10 sec, heat treat (150° C.×6 min), repeat 10 cycles of laundering (JIS L-217) and tumble drying, and visually inspect pleat condition.

Evaluation

○ Pleat retained; one-handed reaction occurred

X Pleat not retained; one-handed reaction did not occur (or was insufficient or excessive)

4. If one-handed reaction has occurred, terminate test.
5. If one-handed reaction has not occurred (or was insufficient or excessive), set different one-handed reaction conditions and repeat (2)–(4) or (2)–(5).

Principle of preliminary test

A resin finished textile is set to its shape at the time of the crosslinking reaction of the resin finishing agent. Therefore, if only one-handed reaction mainly occurs without occurrence of crosslinking reaction, launder-resistant pleats can be set by heat treating the pleated cloth to effect crosslinking. If launder-resistance pleats are obtained, this means that one-handed reaction occurred and that the one-handed reaction conditions are those defined by the invention. On the other hand, if considerable crosslinking reaction has occurred before the heat treatment, the cloth cannot be pleated because no further crosslinking reaction can be caused. If the one-handed reaction is insufficient, launder-resistant pleats cannot be set because the unreacted resin is removed by the water washing.

Since the occurrence/nonoccurrence of one-handed reaction can therefore be ascertained by checking pleat durability in the foregoing manner, the one-handed reaction temperature-time conditions can be determined individually for different resin finishing agent types and concentrations, catalyst types and concentrations, and combinations of resin and catalyst.

Unreacted cellulose-reactive N-methylol compound and reaction catalyst are removed by water washing after the one-handed reaction. The washing can be conducted by a conventional method with, if necessary, addition of a detergent, soda ash or other neutralizing agent. The water washing is followed by drying.

Reaction catalyst is then imparted again. The reaction catalyst imparted at this time can be one ordinarily used in resin finishing. Examples include free acids, ammonium salts and metallic salts. From the points of color fastness and discoloration, a neutral metallic salt catalyst is particularly preferable. The amount of catalyst imparted at this point is suitably about 5–25 wt % (as solids) based on the amount of the cellulose-reactive N-methylol compound added at the time of imparting resin. This is the same as in the conventional process. However, the amount imparted is preferably the minimum required for crosslinking reaction of the resin that has undergone one-handed reaction with the cloth. The drying after the second impartation of catalyst is preferably conducted under conditions that did not cause one-handed reaction in the preliminary test, so as to avoid reaching the crosslinking reaction stage following one-handed reaction. The method of imparting the catalyst is not particularly limited. The ordinary pad dry method or spray drying method can be used.

Garment making is then conducted by an ordinary method.

The finished garment is pleated as required and then heat treated. Like the one-handed reaction conditions, the heat treatment conditions also differ with the type and amount of the imparted resin finishing agent, the type and amount of added catalyst, and the combination of resin finishing agent and catalyst. Although this makes it impossible to define the conditions generally, the heat treatment temperature is necessarily required to be higher than the one-handed reaction temperature. Generally, treatment at a temperature of not lower than 120° C. and lower than 170° C. for not less than 5 minutes and not more than 30 minutes is preferable. When the heat treatment temperature is too low, crease-resistant property and shrink resistance do not improve and other problems occur. When it is too high, loss of cloth strength and other drawbacks arise. When the heat treatment time is too short, the cloth tends not to be evenly heated throughout. This leads to uneven progress of the reaction and other disadvantages. An excessively long heat treatment time degrades and yellows the cloth and is also uneconomical.

The process according to the invention provides a textile containing cellulosic fiber characterized by excellent color fastness, little loss of color fastness or increase in discoloration and formaldehyde concentration owing to long storage between resin impartation and heat treatment, minimal cloth strength loss during resin finishing, superb crease-resistant property and shrink resistance, and good feeling, pleating property and puckering prevention property.

EXAMPLES

Examples of the invention will now be explained.

The percentage and ratio values representing contents and addition amounts in these examples refer to weight percent and ratio unless expressly stated otherwise.

In all of the Examples and Comparative Examples the resin finishing was effected on mercerized 100% cotton 40/2 kanoko (dappled) cloth.

The resin finishing agent and other materials used were as follows:

Riken Resin LNB20: cellulose-reactive N-methylol resin; solids content, 40%; Miki Riken Industries Co., Ltd.

Catalyst M: magnesium chloride; neutral metallic salt catalyst; solids content, 20%; Dainippon Ink And Chemicals Company.

Aqueous solution of zinc fluoroborate: acidic catalyst; concentration, 45%; Morita Chemicals Co., Ltd.

Morinsofter CF: oil-base softener; solids content, 20%; Morin Chemicals Co., Ltd.

AN-980s: aminosilicon-base softener; Ipposha Industries Co., Ltd.

Sumitex Buffer FW: Formaldehyde absorber; ethyleneurea; solids content, 29%; Sumitomo Chemical Co., Ltd.

PEG200: polyethyleneglycol; polymerization degree, 200; Sanyo Chemical Co., Ltd.

The treated cloths obtained in Examples 1 and 2 and Comparative Examples 1–4 were subjected to the following tests:

(1) Tear strength: JIS L-1018 6.17.1 A method (2) Washing shrinkage: JIS L-1018 6.30 F-1 method Tumble drying (3) Wash-and-wear property: JIS L-1018 6.31.1 A method Tumble drying (4) Free formaldehyde: JIS L1041

(5) Seam puckering: JIS L-1905

(6) Feeling: Judged by touch and evaluated as follows:

○ Good feeling with no roughness or hardness

X Somewhat rough and hard (7) Accelerated aging treatment for color fastness and free formaldehyde: 130° C.×30 min steam treatment (equivalent to about three months' aging.)

(8) Pleat durability: Cloth before heat treatment was pleated with a flat press under conditions of 0.5 kg/cm$^2$ surface pressure at 150° C.×10 sec, heat treated (150° C.×6 min) and then subjected to 10 cycles of laundering (JIS L-217) and tumble drying, followed by pleat evaluation:

○ Pleat retained

X Pleat vanished

Examination of color fastness was effected on mercerized 100% cotton 40/2 kanoko (dappled) cloths dyed by a conventional method with dyes of the C.I. numbers shown in Table 1 to the hues of the color densities shown in the same table.

TABLE 1

| Hue | Dye C.I number | Color density (% owf) |
|---|---|---|
| Blue (1) | Reactive Blue 52 | 0.5 |
| Blue (2) | Reactive Blue 19 | 0.5 |
| Red (1) | Reactive Red 56 | 0.5 |
| Red (2) | Reactive Red 111 | 0.5 |
| Turquoise | Reactive Blue 71 | 0.5 |
| Black | Reactive Black 5 | 8 |

Example 1

As shown in Table 2, an aqueous solution containing 15% of Riken Resin LNB-20 as resin finishing agent, 1.5% of zinc fluoroborate as reaction catalyst, 3% of PEG-200 as auxiliary and 1% of Silicolan AN-980s was applied to the cloth by the pad dry method. The cloth was then squeezed with a mangle set to a pickup of 80% and dried at 105° C.×5 min. Water washing was then conducted twice using a jet dyeing machine at a bath ratio of 1:30 at 40° C.×15 min. Next, an aqueous solution containing 4% of Catalyst M as reaction catalyst, 4% of Morinsofter CF as additive and 2% of Buffer FW was imparted to the cloth by the pad dry method, followed by squeezing with a mangle at a pickup of 80%, drying at 100° C.×1.5 min, garment making, pleating at 0.5 kg/cm$^2$ surface pressure at 150° C.×10 sec, and heat treating at 150° C.×6 min. The additives Morinsofter CF and Buffer FW were added at the time of second impartation of catalyst because they would be washed out by the water washing if added at the time of imparting the resin.

Example 2

Resin finishing was conducted in the same manner as in Example 1 except that the drying after imparting resin was effected at 80° C.×20 min.

Comparative Example 1.

Resin finishing was conducted in the same manner as in Example 1 except that the drying after imparting resin was effected at 80° C.×5 min. (Insufficient one-handed reaction)

Comparative Example 2

Resin finishing was conducted in the same manner as in Example 1 except that the drying after imparting resin was effected at 90° C.×60 min. (Excessive one-handed reaction)

Comparative Example 3

Resin finishing was conducted as in conventional post-curing using acidic metallic catalyst as the reaction catalyst for the resin finishing agent.

Comparative Example 4

Resin finishing was conducted as in conventional post-curing using neutral metallic catalyst as the reaction catalyst for the resin finishing agent.

The physical properties and color fastnesses of the resin finished cloths obtained in Examples 1 and 2 and Comparative Examples 1–4 are shown in Table 2(1), (2) and (3).

TABLE 2

| | | No. | | | | | |
|---|---|---|---|---|---|---|---|
| | | Ex. 1 | Ex. 2 | C. Ex. 1 | C. Ex. 2 | C. Ex. 3 | C. Ex. 4 |
| Finishing conditions | | | | | | | |
| Type and concentration (%) of finishing agent when imparting resin | LNB-20 | 15 | 15 | 15 | 15 | 15 | 15 |
| | Zinc fluoroborate | 1.5 | 1.5 | 1.5 | 1.5 | 1.5 | — |
| | Catalyst M | — | — | — | — | — | 4 |
| | Silicolan AN-980s | 1 | 1 | 1 | 1 | 1 | 1 |
| | PEG-200 | 3 | 3 | 3 | 3 | 3 | 3 |
| | Morinsofter CF | — | — | — | — | 4 | 4 |
| | Buffer FW | — | — | — | — | 2 | 2 |
| Conditions of drying after imparting resin | | 105° C. × 5 min | 80° C. × 20 min | 80° C. × 5 min | 90° C. × 60 min | 105° C. × 5 min | 105° C. × 5 min |
| Water washing | | 40° C. × 15 min (twice) | | | | — | |
| Type and concentration of finishing agent at second imparting of catalyst; drying conditions | | Catalyst M 4% Morinsofter CF 4% 100° C. × 1.5 min Buffer FW 2% | | | | — | |
| Pleating | | 0.5 kg/cm$^2$ surface pressure, 150° C. × 10 sec | | | | | |
| Heat treatment | | 150° C. × 6 min | | | | | |
| Physical properties | | | | | | | |
| Pleat durability | | ○ | ○ | X | X | ○ | ○ |
| Washing shrinkage [course + wale] (%) | | 4.5 | 4.8 | 9.8 | 6.0 | 6.5 | 6.5 |
| Wash&Wear (Class) | | 3.7 | 3.6 | 3.0 | 3.7 | 3.5 | 3.5 |
| Bursting strength (kg/cm$^2$) | | 5.9 | 5.6 | 7.2 | 3.8 | 5.3 | 5.2 |
| Puckering (Class) | | 4 | 4 | 2 | 2 | 3.5 | 3.5 |
| Formaldehyde (ppm) | Just after finishing | 30 | 22 | 12 | 45 | 55 | 40 |
| | After accelerated aging | 42 | 34 | 11 | 60 | 195 | 102 |
| Feeling | | ○ | ○ | ○ | X | X | X |
| Color fastness <Class> | | | | | | | |
| Change in color by resin finishing (Evaluated by JIS L-804 based on cloth hue before resin finishing) | Blue (1) | 4–5 | 4–5 | 4–5 | 4–5 | 4–5 | 4 |
| | Blue (2) | 4–5 | 4–5 | 4–5 | 4–5 | 4–5 | 4 |
| | Red (2) | 4–5 | 4–5 | 4–5 | 4–5 | 4–5 | 4 |
| | Turquoise | 4–5 | 4–5 | 4–5 | 4–5 | 4–5 | 4 |
| Lightfastness JIS L-842 No. 3 exposure method (Evaluation by JIS L-804) | Blue (1) | 4 | 4 | 4 | 4 | 4 | 3–4 |
| | Blue (2) | 4 | 4 | 4 | 4 | 4 | 3–4 |
| | Turquoise | 4 | 4 | 4 | 4 | 4 | 3–4 |
| Nitrogen oxide gas fastness JIS L-855 (Strong test) | Blue (1) | 4 | 4 | 4 | 4 | 4 | 3 |
| Perspiration fastness after accelerated aging JIS L-848 (A method Cotton staining) | Black | 4–5 | 4–5 | 4–5 | 4–5 | 3–4 | 4–5 |

As shown in Table 2, the cloths containing cellulosic fiber processed by the invention in Examples 1 and 2 had excellent shrink resistance and crease-resistant property owing to occurrence of one-handed reaction, while they also exhibited pleat durability and anti-puckering property on a par with those obtained by conventional postcuring. In Comparative Example 1, on the other hand, the imparted resin remained unreacted and washed out, so that no shrink resistance or crease-resistant property was obtained. To the contrary, in Comparative Example 2, since resin crosslinking reaction had already progressed prior to the heat treatment stage, pleatability and anti-puckering property were not obtained and the feeling was hard.

Moreover, Examples 1 and 2 achieved better crease-resistant property, shrink resistance and feeling than Comparative Examples 3 and 4 according to the finishing process of conventional postcuring. The increase in formaldehyde after accelerated aging was also low. Although a marked decrease in perspiration fastness was experienced in Comparative Example 3 and marked decreases in lightfastness and nitrogen oxide gas fastness were experienced in Comparative Example 4, Examples 1 and 2 gave excellent results in all of these test categories.

What is claimed is:

1. A process for resin finishing textile containing cellulosic fiber comprising the steps of imparting a resin finishing agent containing a cellulose-reactive N-methylol compound having two or more functional groups and a reaction catalyst to textile containing cellulosic fiber, reacting essentially only one functional group of the cellulose-reactive N-methylol compound with cellulose, effecting water washing to remove unreacted cellulose-reactive N-methylol compound and the reaction catalyst, again imparting reaction catalyst, and effecting drying, garment making and heat treatment.

2. The process according to claim 1, wherein the cellulose-reactive N-methylol compound has two functional groups.

3. The process according to claim 1, wherein a determination of whether the reaction of essentially only one functional group of the cellulose-reactive N-methylol compound occurred is ascertained by conducting a pleat durability test on cloth of the textile containing cellulosic fiber after the second imparting of reaction catalyst and drying, said pleat durability test comprising pleating said cloth with a flat press under a surface pressure of 0.5 kg/cm$^2$ at 150° C. for 10 seconds, followed by heat treating at 150° C. for 6 minutes, subjecting the pleated cloth to 10 cycles of laundering, tumble-drying and then determining whether the pleat is retained.

* * * * *